United States Patent [19]

Wilensky

[11] Patent Number: 4,553,397

[45] Date of Patent: Nov. 19, 1985

[54] METHOD AND APPARATUS FOR A THERMODYNAMIC CYCLE BY USE OF COMPRESSION

[75] Inventor: Joseph Wilensky, Denver, Colo.

[73] Assignees: Soma Kurtis; Jack Sloan, both of Denver, Colo.

[21] Appl. No.: 506,708

[22] Filed: Jun. 20, 1983

Related U.S. Application Data

[63] Continuation-in-part of Ser. No. 262,783, May 11, 1981, Pat. No. 4,442,675.

[51] Int. Cl.[4] ..... F01K 25/06

[52] U.S. Cl. ..... 60/649; 60/654; 415/176

[58] Field of Search ..... 60/649, 653, 654, 673, 60/688, 689; 415/176; 417/13

[56] References Cited

U.S. PATENT DOCUMENTS

| | | | |
|---|---|---|---|
| 3,314,236 | 4/1967 | Zanoni | 60/654 |
| 4,249,384 | 2/1981 | Harris | 60/654 X |
| 4,389,603 | 8/1983 | Rodwell | 60/653 |

*Primary Examiner*—Stephen F. Husar
*Attorney, Agent, or Firm*—Jack C. Sloan

[57] ABSTRACT

A working fluid in the gaseous state at some initial temperature and pressure is expanded polytropically to a resulting exhaust fluid having some lower temperature and pressure in order to produce useful work. Large quantities of a pressured motive liquid are then employed as the vehicle for approximating an isenthalpic compression of the working fluid. The preferred method for effecting this recompression is to provide an overall adiabatic environment within which the two fluids are placed in thermal but not physical communication. The working fluid is then energized by direct compression during which partial condensation of the working fluid is accompanied by heat transfer to the motive liquid. Thereafter the two fluids are mixed, with the resulting two phases permitting separation and reconstitution of the motive and working fluids to their initial states to complete the thermodynamic cycle which, depending upon the fluids selected, can be located in a broad range of the temperature spectrum.

66 Claims, 3 Drawing Figures

INDUCTION-DELIVERY COOLANT PUMP
LOW PRESSURE RESERVOIR
RECOVERY COMPRESSOR
C
B
2
3
4
4a
5
6
21
22
23
24
46
47
48
49
50
51
52
53
53a
54

METHOD AND APPARATUS FOR A THERMODYNAMIC CYCLE BY USE OF COMPRESSION

BACKGROUND OF THE INVENTION

This patent application is a continuation-in-part of my copending application entitled "Method for Thermodynamic Cycle" filed May 11, 1981 having Ser. No. 262,783, now U.S. Pat. No. 4,442,675.

FIELD OF THE INVENTION

This invention relates generally to obtaining useful work from the polytropic expansion of working fluids by reversible adiabatic expansion. More particularly it is concerned with a method of restoring such working fluids to their original thermodynamic conditions by means of an approximate isenthalpic compression, followed by heating, preferably by the use of ambient heat sources.

DESCRIPTION OF THE PRIOR ART

Useful work production by heating and vaporization of liquids, including cryogenic liquids under pressure, and thereafter expansion to exhaust vapors is well known. Most current techniques, however, particularly those designed to employ ambient heat sources, assume a continuous supply of working fluid from outside sources and are not concerned with recompressing and condensing exhaust vapors back to the liquid state in order to achieve a "closed" thermodynamic cycle.

SUMMARY OF THE INVENTION

An understanding of this invention is best achieved by first discussing certain theoretical considerations of the laws of thermodynamics and thereafter relating these considerations to the invention by means of thermodynamic charts, diagrams, and supporting mathematical equations. Finally, exemplary physical embodiments of the invention will be placed in a working environment to demonstrate how useful rsults can be obtained.

The theoretical discussion must start with the realization that in all attempts to obtain work from heat the concept of force is indispensible. For such processes to be continuous, an assumed inexhaustible souce of force can only be replaced by a source of force which when exhausted can be replenished. Within the confines of this disclosure the above statement implies the circulation of a working fluid at high temperature and pressure, giving up work energy and exhausting to low temperature and pressure. The working fluid must then be reenergized by repressuring and reheating it to its original state in order to complete the cycle. If all of these steps were to take place perfectly, the relationship of heat to work conversion would become independent of path, devices, purposes and depend only on the thermodynamic states of the working fluid. The invariable result of any such energy cycle, if carried out perfectly, would be that only the heat removed from the total heat in the course of the expansion would be converted to work. If additional heat were removed, both heats would have to be replaced to reconstitute the total heat. The concept yields the following well-known relationship (using the thermodynamic temperature scale):

$$\frac{W}{Q} = \frac{T_1 - T_2}{T_1} \qquad \text{EQUATION 1}$$

where:

W = Net work output

Q = Gross heat input $T_1$ = Thermodynamic absolute temperature attained after gross heat input $T_2$ = Thermodynamic absolute temperature attained after heat output This relationship of heat to work is often referred to as the Carnot Limitation and $T_2$ has often been called the "sink temperature" and described as a point of limitless heat disposal, so large as to be essentially unaffected by such heat disposal. This conclusion is reached in view of the cycle as described in Equation 1 being forced to discard heat at temperature $T_2$. That it must discard heat at a permanent, unaffected lower temperature has set an impassable limitation, preventing the re-use of the heat thus discarded. Heretofore, the repressuring of the working fluid without the total expenditure of work output has only been accomplished at the irrevocable sacrifice of the latent heat of vaporization.

This invention has many aspects and applications but its most important and fundamental teaching is that the need for a "heat sink" as the necessary interpretation of the lower temperature in the relationship:

$$W/q = (T_1 - T_2)/T_1$$

is not invariably true, nor is its interpretation as a limitation. Even though it remains true that in the course of a single trip through a thermodynamic cycle, the total heat encompassed by the working fluid between the temperature extremes may produce only the net work available in Equation 1, it is not necessarily true that the residual heat must be lost or discarded irrevocably. Through isenthalpic compression it may be maintained as a heat inventory to be recycled, implemented by additional heat, and re-used as a vehicle by which an added portion of heat may be sequestered and employed to produce useful work at a high degree of efficiency.

The vehicle for accomplishing this is a large quantity of motive liquid which absorbs the residual heat of the working fluid and restores it at a pressure which then becomes available for the production of useful work. Hence, the process of deriving work from heat is no longer moored to a local ambient temperatue as a heat sink. This permits the work derivation to be conducted at any point of convenience in the temperature spectrum. Consequently, Equation 1 may now be contemplated in its true perspective: W/Q, the conversion ratio of work to heat in a single pass of a working fluid through a thermodynamic cycle, approaches unity either as the higher temperature gets very high or as the lower temperature gets very low.

The above theoretical considerations can be clarified if they are also related to a thermodynamic chart such as the one depicted in FIG. 1 wherein the thermodynamic variable, temperature T, in degrees Rankine, is presented as the linear ordinate and the thermodynamic variable, entropy S, in BTU/lb.-degree Rankine, as the linear abscissa. Isobars connect paired values of the coordinates at equal pressure, P, in pounds per square inch absolute. Isenthalpic lines connect paired values of the coordinates at equal values of the heat content, H, in BTU/lb. A heavier, dome-shaped, curved line ("phase envelope" or "vapor-liquid phase envelope") depicts the boundary condition of vapor-liquid equilibrium wherein the vapor and liquid phases of a chemical species in the absence of other species may exist simultaneously and contiguously. Paired values of the coordinates enclosed below this boundary represent the values of the coordinates for the algebraic combination of the properties of the liquid and vapor at the phase envelope in their existing proportions.

It is of particular importance to note here the effect of the presence of more than one chemical species on the interpretation of the parameters and variables of this chart. Those skilled in the art will recognize that for each additional species present, one additional degree of freedom is made available. The consequence of this are that, although horizontal lines within the envelope still connect points of equal temperature and pressure, they do not, in general, connect points of equal composition, i.e., mass fractions of the chemical species, in the two different phases represented in this region. It is intended in this invention to derive important benefits from this inequality.

The highest point, CP, of the phase envelope is termed the "critical point", the value of the ordinate at this point the "critical temperature", and the value of the pressure along the isobar through this point (and tangent to the envelope at this point) the critical pressure.

At all points on the chart at temperatures greater than the critical temperature the fluid is entirely in the gaseous state and noncondensible by any means unless cooled below that temperature. The region below this temperature enclosed by the axes and the left side of the phase envelope is entirely liquid. In the body of this region vapor may be created by combinations of finite changes of temperature and pressure and is termed "sub-cooled". At the phase envelope boundary, the liquid is termed "saturated" and any increase in temperature or decrease in pressure will be accompanied by some evaporation. The region below the critical temperature and to the right of the phase envelope consists entirely of vapor. In the body of this region finite amounts of reduction in temperature and/or increase in pressure may accomplish some condensation. The vapor in this region is termed "superheated". At the right phase envelope boundary, the vapor is termed "saturated" such that any decrease in temperature or increase in pressure will be accompanied by some condensation.

Within the phase envelope itself there is a conceptualized region of mixed vapor and liquid phases. Here, isobars are horizontal, i.e., parallel to the abscissa, and connect points on the envelope of identical temperature and pressure which are termed "saturation temperature" and "saturation pressure" or "vapor-liquid equilibrium temperature and pressure". Quality, defined as the mass fraction of vapor in the mixed-phase region, for any of the thermodynamic functions within the vapor-liquid envelope, may be entirely ascertained by linear algebraic interpolation of the values for the function of the pure phases of a single chemical species at saturation. For mixtures this relationship will, in general, not be linear. Lines of constant composition, however, not necessarily horizontal, can be plotted in the region to facilitate computations.

Thus, such a temperature vs. entropy chart conveniently describes the thermodynamic states through which the cycle of this invention passes. To this end, a description of three states (also called "conditions" or "points") is essential. State A represents the point of highest pressure, $P_1$, and temperature, $T_1$, of the working fluid. State B represents the point of lowest pressure, $P_2$, and temperature, $T_2$. State B could initially fall within the vapor-liquid phase envelope as shown in FIG. 1, or initially fall outside the envelope and thereafter be forced into the envelope by various methods hereinafter discussed. In any event, the working fluid in State B is usually referred to as the exhaust vapor (it is also called the "exhaust fluid" or the "low pressure working fluid"). State C represents the system nominal high pressure, $P_3$, at an intermediate temperature, $T_3$. As in the case of state B, state C could also lie without the phase envelope or lie within it to the left of the saturated vapor line as shown in FIG. 1. Any given state B is connected to any given state C by a line of constant enthalpy. Other points X, J, CP, B', and C' are also located for clarification of certain theoretical considerations of this invention hereinafter discussed.

For example, one such theoretical consideration is that state B may be anywhere on the chart where the working fluid is at least partially vaporized and its temperature is lower than the critical temperature. It should be noted that throughout this patent disclosure, state B is conceptualized to include state B' which is at the same pressure but higher enthalpy than state B. Similarly, state C is conceptualized to include state C' which is at the same pressure but different enthalpy than state C. State C lies on the same line of constant enthalpy but at higher pressure than state B'. The path from B' to C' represents the path realized in an isenthalpic compression to the pressure of C from B', the actual enthalpy change from B' to C' reflecting the additional work needed to overcome mechanical imperfections, overcome the natural tendency of the fluid to expand, and any net removal of heat from the working fluid. Point X for the purposes of this disclosure is a state along the saturated liquid boundary of the phase envelope. The specific location as shown in FIG. 1 is that of the state of saturated liquid at the temperature and pressure of state B. Those skilled in the art will appreciate that the path from point B' to point C is accompanied by an equal change in energy to that which would be undergone by following the composite path from point B' to point X and thence from point X to point C. Therefore, since B' and C are at equal enthalpy, for every drop of liquid condensed from exhaust fluid vapor the latent heat of vaporization of that amount of condensate in going from point B' to point X will be identically equal to the heat replacement required to restore that condensate from point X to point C. Furthermore, the characteristics of any working fluid are such that at successively lower exhaust fluid pressures, point C' tends to depart progressively from point C. The coincidence of point C' with point A would, in effect, cancel the advantages of the thermodynamic work cycle of this invention.

As indicated by current practice the technologies for effecting the transition along the thermodynamic paths from state A to state B and from state C to state A are well known. Methods and apparatus employed to produce the transition of the working fluid from state B to state C constitute the fundamental aspects of this invention. Nonetheless, the A to B and C to A paths have important interrelationships with this invention which should be clarified. Starting at state A we have a working fluid at system high pressure and at whatever temperature that can be provided. This working fluid can expand in any manner from entirely free, unopposed liberation to closely restricted, almost shutoff resistance to that expansion such that only a differential tendency to expand exists. The former, "free" expansion not being called upon to overcome resistance retains virtually its entire energy content and is thus, by definition, isenthalpic. It is termed "irreversible", represents essentially horizontal movement to the right of a point such as point A, and loses temperature only to the extent of the pressure-volume loss of the working fluid.

This phenomenon is known as Joule-Thompson expansion and can, in actuality, result in a rise in temperature if the change in the actual pressure-volume product is a gain. There is a point of reversal of this tendency that can be identified with any energy level of a working fluid. This is known as the Joule-Thompson inversion point which has been shown in FIG. 1 as point J for the specific line of constant enthalpy traversed in this isenthalpic compression.

On the other hand, almost equal opposition requires the expanding gas to do considerable quantities of work to overcome the opposition. This work is obtained at the expense of internal energy and/or the pressure-volume potential. A drop in pressure due to the inhibited expansion will in this case be accompanied by a large temperature decrease. For a truly differential pressure gradient, this energy transfer yields the maximum work output of the thermodynamic transformation. Using only internal heat, a maximum is converted to work in a process labeled "reversible adiabatic" and characterized by no change in the property called "entropy" and thus is called isentropic. Naturally, practical considerations such as thermal inefficiency, friction, etc., preclude perfect reversibility. Perfect isentropic expansion would be depicted on the chart by a vertical movement from point A to point B. In reality, at the thermal efficiencies achieved, the path from A to B′ is followed and slightly less useful work output is realized at the higher enthalpy of point B′. This practical approach to isentropic expansion is often referred to as "polytropic" expansion.

This invention contemplates the employment of any and all expansion devices known to the art that suit the stages of expansion along this path from A to B′. Expansion through a turbine to produce shaft work is the most common example. This invention also contemplates the provision of expansion engines that cause the path from point A to point B′ to enter the vapor-liquid phase envelope progressively, avoiding the shock and vibration caused by the abrupt, in-flow contraction accompanying condensation in turbine channels. Care should be taken, however, to prevent point B from ever entering any region where any portion of the working fluid might be solidified. That is to say, the state conditions should never be permitted to go below the triple point of the working fluid.

It should also be pointed out that the cryogenic methods known as Joule-Thompson free expansion processes or Joule-Thompson engine expansion processes can be utilized to force the working fluid into the vapor-liquid phase envelope and/or along the path from point B to point C since they are capable of producing extremes of low temperature, limited only by insulation efficiency. Thus, for purposes of initial start-up, control, fluid replenishment and/or deliberate discarding of heat from either the motive fluid or the working fluid, use of such Joule-Thompson expansion systems may prove advantageous in the practical practice of this invention.

A beginning appreciation of the thermodynamic, mechanical and hence, economic advantages of this invention can best be gained by comparing the B to A return path alternatives. If one were to recompress directly the working fluid, he would essentially return along the same vertical path (i.e., from point B to point A) since the fluid in itself would require the restoration of all the work it had yielded in the isentropic expansion. If the path from point B to point X and then from point X to point A were followed the latent heat of vaporization would have to be discarded in reaching point X. Alternatively, this invention contemplates the introduction of a "shortcut" to provide as much as possible for the exhaust fluid to be liquefied to an incompressible state, but in any case to restore pressure to the working fluid without the temperature rise of polytropic compression. This is possible since raising the pressure of any incompressible liquid can be accomplished without doing work. Also, by limiting the temperature rise the work required for repressuring the working fluid is substantially reduced.

If the working fluid at state B were noncondensible it would be possible to envision a "free recompression" by constant cooling of the fluid by maintenance of constant temperature in the fluid during compression. As in Joule-Thompson expansion, the fluid would experience little rise in enthalpy. For a condensible fluid, however, a rise in pressure will be accompanied by condensation and the accompanying release of latent heat of vaporization will result in a temperature rise. Thus the analogue to the isothermal compression of a noncondensible gas is the isenthalpic compression of a condensible gas. This, in a sense, is the compression counterpart of irreversible or "free" expansion.

The central aim of this invention is to avoid the waste of latent heat of vaporization experienced in conventional power cycles. To do so attention must be focussed on a method and means for accomplishing the pertinent step of re-energizing the working fluid from state B to state C without expending all the energy yielded in its expansion or discarding all of its latent heat of vaporization in order to render it in an incompressible state for pumping. The method of this invention will be isenthalpic compression as described and for the reasons given above. It is of no small additional advantage that this method also frees the system from the restrictions of a heat sink and thus from the overall limitation of Carnot, although it still prevails in a localized immediate sense during actual repressuring. Furthermore, this freedom extends to the temperature level at which the cycle is conducted and thence the sources which may be made available to supply the thermal energy for conversion to useful work. The latter is a consequence of a latitude of choice in fitting suitable working fluids and circumstances to place states A, B, and C conveniently in and around the phase envelope.

The means for accomplishing this isenthalpic compression will be the employment of a large quantity of an incompressible liquid, miscible with the working fluid under the conditions imposed in suitable apparatus for the compression. To understand the function of this liquid and to clarify the behavior of the two fluids during the thermodynamic transition of the working fluid from state B to state C, we present first an idealized, theoretical process and apparatus for examination.

Consider a well insulated vessel filled with exhaust fluid vapor saturated at state B. Connected to the vessel is an unlimited supply of the chosen liquid pumped to the pressure of state C. In this overall adiabatic environment, the liquid is admitted to the vessel and will flow into the vessel compressing the working fluid until it, and the entire system, reaches the pressure of state C, whereupon flow will cease. Moreover, let the liquid be introduced through a frictionless spray to insure instantaneous establishment of physical and chemical equilibrium between the two fluids. It is clear that, under these circumstances, the compression of the working fluid is strictly nonadiabatic. In fact, the whole process may be viewed as a series of differential pressure increases during which the adiabatic temperature rise of the working fluid is prevented by the presence of the liquid. Indeed, each small pressure step may be viewed as virtually an isothermal compression of the working fluid. As a result, a portion of the working fluid condenses, releasing its latent heat of vaporization to the large quantity of liquid where it is absorbed as sensible heat. Unless the original liquid temperature was very much colder than the working fluid, the temperature of the entire system rises to the saturation temperature corresponding to the new, higher, pressure. If the temperature of the liquid was not so low as to have condensed the total working fluid, the end result of the overall process will be a vessel containing a liquid and a vapor phase at the pressure of state C and the corresponding saturation temperature for liquid and vapor composed of a single identical chemical species. If more than one species is present, the temperature and composition of the two phases will be those of vapor-liquid equilibrium at the given pressure. That is to say, the characteristics of each phase on and within the vapor-liquid envelope will vary according to the relative proportions of the different chemical species present. In either case, under properly chosen conditions, the original working fluid quantity will appear as the total vapor plus the surplus liquid over the amount of compressive liquid introduced.

Since we seek to "close" the thermodynamic cycle, it is clear that the amount of liquid must be circulated. Therefore, the composition of the liquid (and therefore, the two-phase working fluid by reason of material balance) must be constant. This will indeed be true as the nature of the system as described will seek a steady-state constant composition of both phases. Still another restriction is, however, imposed in a closed cycle: the circulating liquid can only be available saturated at state C, unless heat is removed from it during circulation at some point external to the compression system.

Consider, now, the behavior of the liquid during compression when admitted at saturation temperature. As the first drop of liquid enters, it expands to the lower pessure, evaporates, and absorbs a very small amount of heat of vaporization, cooling the system. Nevertheless, the vapor undergoes very nearly a small adiabatic compression. As more liquid is admitted, one of two events occurs first, depending upon the thermodynamic nature of the chosen liquid in combination with the working vapor. One possibility is that the evaporation of liquid continues at slowing rates as the pressure rises and the total mass of vapor to be compressed and heated grows larger. Finally, state C pressure is reached as a single vapor phase containing all the latent heat of vaporization of the working fluid, but expended uselessly in evaporating a now useless quantity of liquid. The more likely possibility will be that a state will be reached in the vessel where the liquid will not totally evaporate but start a second, liquid phase in the vessel saturated at the current pressure. Thereafter, as more liquid is admitted, more condensate appears until final pressure is reached. It may even transpire that there will be enough condensation for the chosen materials and conditions to result in some net condensation of the working fluid. In any case, the final conditions can be calculated by conventional methods, and it will be seen that for any condensation to occur, a definite minimum amount of liquid must be employed. Beyond this, additional liquid will only contribute more of a material already saturated at the conditions of the two-phase system and thus have no more than the negligible effect of the small amount of energy consumed in pumping. It is possible that one might encounter fluids and conditions naturally fulfilling these criteria. It is not as likely that one will encounter a natural system combining the virtues of preferred available fluids operating at advantageous conditions under optimal economic circumstances.

Removing heat from the working fluid is a possible remedy. That is to say, one may deliberately condense sufficient working fluid to reconstitute the liquid. This, however, would be cumbersome, expensive, and wasteful in all but the smallest amounts of such cooling requirements. A better solution is to remove just sufficient heat from the liquid to result in the smallest amount of net working fluid condensation during the compression process. Increased heat removal beyond this point would serve no useful purpose as latent heat of the working fluid is being discarded. In fact, a point of liquid precooling can be reached which will result in the total condensation of the working fluid thereby vitiating all the benefits of this invention. Introducing sub-cooled compression liquid to the vessel results in reaching the point of formation of a liquid phase in the vessel sooner and in increasing the amount of liquid at state C. The amount of net working fluid condensation as well as the amount of circulating liquid required is thus determined by the external heat removal from the liquid. This, in turn, has made possible a choice of fluids for use at selected states A, B, and C in the practice of this invention.

The overall result of this idealized system is that the working fluid composed of the total vapor combined with liquid surplus of the energizing system has been conveyed in composition and quantity to state C by the action of a circulating liquid, in a process suitable for incorporation in a closed thermodynamic cycle. The large mass of liquid, acting as a temporary repository for latent heat of vaporization, has served as a vehicle, much like a flywheel, for the working fluid, limiting its temperature rise, preventing its superheating, and preserving the two fluids at equal temperatures throughout the compression. Having added only the small amount of energy necessary for imparting a differential head to energize and move the circulating incompressible liquid, and this being mostly recoverable as a parasitic consumption of work for the overall cycle, the system has approximated an isenthalpic compression of the working fluid.

Practicalities demand, however, that some work be done to compensate for mechanical inefficiencies, to overcome friction, etc., so there are always departures from true constant enthalpy. Their presence is acknowledged in this patent application by use of expressions such as "approximating an isenthalpic compression." In addition, continuity of operation, the use of multiple stages and/or other methods of energizing the working fluid in conjunction with direct compression, and problems in handling and restoration of the two fluids make impractical the use of the simple single vessel employed in the idealized theoretical example given above. Furthermore, it is clear that it may be of great practical advantage to depart purposely from true constant enthalpy by deliberately discarding heat from the system to realize operation at selected states A, B, and C for given fluids.

Although there are other devices for reducing to practice this approximate isenthalpic compression, in view of the above practical considerations this invention prefers the use of a specific method (or "apparatus") hereinafter referred to as isenthalpic compression (or an "isenthalpic compressor") for forcing an isenthalpic compression of the working fluid from a state B to a state C.

This preferred method energizes the working fluid by thermally, but not physically, communicating it with a large quantity of a circulating incompressible liquid (also referred to as the "motive fluid" or "motive liquid") throughout a process of direct compression of the working fluid vapor. We add here, parenthetically, that any working fluid liquid at state B may be pumped directly and thus presents no problem of energy waste. A typical device for performing this operation would be a conventional isothermal compressor, circulating the motive liquid through the passageways of its coolant jacket, while holding pressure on the liquid by means of a downstream throttle to prevent premature vaporization.

The motive liquid performs its functions as it cycles between an energized and a de-energized state. In the context of this invention the expression "energizing" implies that portion of the total energy consumed in restoring either fluid to its highest pressure state without regard to temperature. The quantity of the motive liquid may be obtained from a variety of sources such as an external feed stream, recycle of an fixed internal or external inventory, condensation of excess working fluid, etc. In actual practice, the freedom to discard heat from the motive liquid must be included for economic as well as practical reasons. This measure will permit a latitude of choice of working and motive fluids at desirable thermodynamic states, reflecting directly on compression stages, circulating quantities, use of parasitic power, overall plant size, and ultimate profitability.

In its simplest embodiment, the preferred method receives both effluent fluid streams from the isenthalpic compression in a vessel employed as a phase separator where upstream pressure is held on the working fluid vapor while the fluids are physically mixed and separated into liquid and vapor phases in physical and chemical equilibrium. A typical device to be employed for the purpose would be a conventional disengaging drum equipped with an inlet liquid spray nozzle, a vapor phase back pressure controller, an internal de-mister mesh blanket, a liquid level controller, and two liquid bottoms pumps One pump would circulate motive liquid under flow control. The other, under liquid level control, would pump the excess liquid downstream to join the total vapor product as the working fluid quantity and composition.

In more complicated embodiments, additional measures may be employed to accomplish the energizing of the working fluid and/or the physical communication and mixing of the two fluids. For high compression ratios of state C to state B, several direct compression stages may be used. Where economics or particular advantages in phase resolution are available some portion of the communication and mixing may be accomplished through jet eduction of the working fluid into the motive liquid prior to and/or following a stage or stages of direct compression. In fact, some degree of energizing of the working fluid may be achieved in the jet eduction itself. A typical device for the latter procedures would be a commercial water heater normally intended for use as a boiler feedwater heater pressed into this service. In order to accomplish any of these more complex methods, the motive liquid may be pumped to sufficiently high pressure to permit it to be cascaded through more than one step of the energizing and physical combination of the two fluids.

Cooling of the motive fluid, if elected, may be accomplished in devices known as heat exchangers thereby conserving within the system the heat lost in the cooling. Colder streams which are to be heated are employed as the second fluid in such heat exchangers to recover and retain the heat. In such devices the fluids are thermally communicated without physical contact between the two fluid streams exchanging heat.

With regard to the subject of heating, it should also be noted that regardless of the method used for achieving the isenthalpic compression from state B to state C, the heating required to drive the working fluid from state C to state A can be supplied by heat exchange using any convenient source of heat. Ambient sources of surroundings, space, atmosphere, bodies of water, geothermal heat, solar heat, fossil fuel oxidation, nuclear heat and waste heat of nuclear reactors, low temperature level sources otherwise neglected, industrial processes and their effluent waste streams are but a few examples.

Like the A to B portion of the cycle, the C to A portion is also a well known prior art. Implicit in the use of heat exchangers in moving from a point C back to a sub-ambient point A is the fact that in the natural course of such sub-ambient heating a wide range of temperatures for refrigeration by the working fluid (the techniques of which are well known to the art) is made available for selection by the choice of working and motive fluids, and states B and C, in this invention. Air, for example, might be the working fluid which in the course of evaporation in this invention would supply deep (i.e., very low temperature) refrigeration and, as in all sub-ambient cases of this invention, in addition to the shaft work produced. An additional consideration in the C to A step is the controlling of back pressure imposed on the working fluid in the restoration of the fluid quantities and composition. Such back pressure will set the upper limit attainable in the energizing step.

Implicit in the concept of the use of different chemical species for the motive liquid and working fluid is the understanding that these two streams may themselves represent chemical mixtures. In fact, the composition of each of the two fluids may include essential quantities of several different chemical species each of which may be incorporated in one or the other or both of the two fluids as in the case of air. The choice of their compositions will depend upon their expediency in the particular service intended for the overall enterprise. Their selection will be readily determined by conventional technical calculations. A typical combination of this type would be ammonia vapor containing minor amounts of water vapor and aqueous ammonia. Other common working fluids, with their critical constants would include, but not be limited to, the following fluids given with their refrigerant number designations where appropriate, as taken from the American Society of Heating, Refrigerating, and Air Conditioning Engineers, Inc., "Thermodynamic Properties of Refrigerants", New York (1969).

| Working Fluid | Refrigerant No. | Critical Temperature Deg. F. | Critical Pressure PSIA |
|---|---|---|---|
| Argon | 740 | −188.12 | 710.4 |
| Oxygen | 732 | −181.08 | 736.8 |
| Air | 729 | −221.31 | 547.4 |
| Nitrogen | 728 | −232.40 | 493.1 |
| Neon | 720 | −379.74 | 384.8 |
| Helium | 704 | −450.31 | 33.2 |
| Para Hydrogen | 702p | −400.31 | 187.5 |
| Normal Hydrogen | 1270 | 197.17 | 670.2 |
| Carbon Dioxide | 744 | 87.87 | 1069.9 |
| Ammonia | 717 | 217.4 | 1647.0 |
| Azeotrope R-12 | 500 | 221.9 | 641.9 |
| Dichlorotetrafluoroethane | 114 | 294.3 | 498.9 |
| Chlorodifluoromethane | 22 | 83.9 | 721.9 |
| Dichlorodifluoromethane | 12 | 233.6 | 597 |
| Trichlorofluoromethane | 11 | 388.4 | 640 |
| Other halogenated hydrocarbons | — | — | — |
| Water | — | 705.4 | 3206.2 |
| Light hydrocarbons | — | — | — |

Helium has particlarly attractive thermodynamic, chemical, and non-toxic properties which make it ideal for many applications of the practice of this invention.

Having thus described a preferred method for accomplishing isenthalpic compression, it now remains to place this invention in context. Clearly, the ability to compress a fluid isenthalpically from state B to state C has utility in its own right. That is to say, the state A to B and C to A context of a "working fluid" moving through a power cycle is not a necessary condition for the utility of the state B to C isenthalpic compression. For example, the state B to C isenthalpic compression might be independently employed to provide for (1) production of refrigeration, with no concomitant production of shaft work; (2) efficient transmission of electrical power by use of motive and working fluids in the temperature range of superconductivity; (3) the provision of safe, sterile conditions associated with operations at low temperatures; and (4) miniaturizaton of machinery by realizing the advantages of low temperature operations, that is, taking advantage of the fact that in Equation 1, as $T_2$ approaches zero, the efficiency of the state B to state C step approaches 100 percent, i.e., a nearly complete conversion of heat to work.

When all is said and done, however, the preferred context for an isenthalpic compression is a thermodynamic cycle capable of producing useful work, and the most preferred context would be a "closed" thermodynamic cycle. Such cycles would comprise:

(1) expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) energizing the working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid by (a) pumping a large quantity of a motive liquid to a pressure at least as great as $P_3$ and sufficiently high to preserve its liquid state while receiving sensible heat from the working fluid;

(b) communicating the working fluid with the pressured motive liquid in an overall adiabatic environment so that there is a local transfer of thermal energy between the two fluids while maintaining their physical separation, wherein the motive liquid serves to limit the temperature rise and prevent superheating of the working fluid by preserving the two fluids at equal temperatures; and (c) compressing the working fluid directly, while subject to these conditions, to a pressure $P_3$ and temperature $T_3$, during which compression there is at least partial condensation of the working fluid and concomitant release of the condensate latent heat of vaporization to the motive liquid, thus achieving state C for the working fluid;

(3) mixing a two-phase effluent of the direct compression with a throttled liquid coolant of a compressor while holding back pressure $P_3$ on the working fluid so that the two phases, a liquid and a vapor, resulting are in physical and chemical equilibrium, wherein the motive fluid is reconstituted in all respects in its initial state as a portion of the resulting liquid phase, and the quantity and composition of the working fluid is restored as the combination of the total resulting vapor and the remainder of the resulting liquid; and (4) heating the working fluid as necessary to achieve temperature $T_1$, thus reconstituting the original quantity, composition, energized pressure, and highest temperature of the working fluid which is to say in all respects in state A;

whereby an approximate isenthalpic compression of the working fluid is incorporated in a thermodynamic cycle.

DESCRIPTION OF THE PREFERRED EMBODIMENTS

Figure 1:
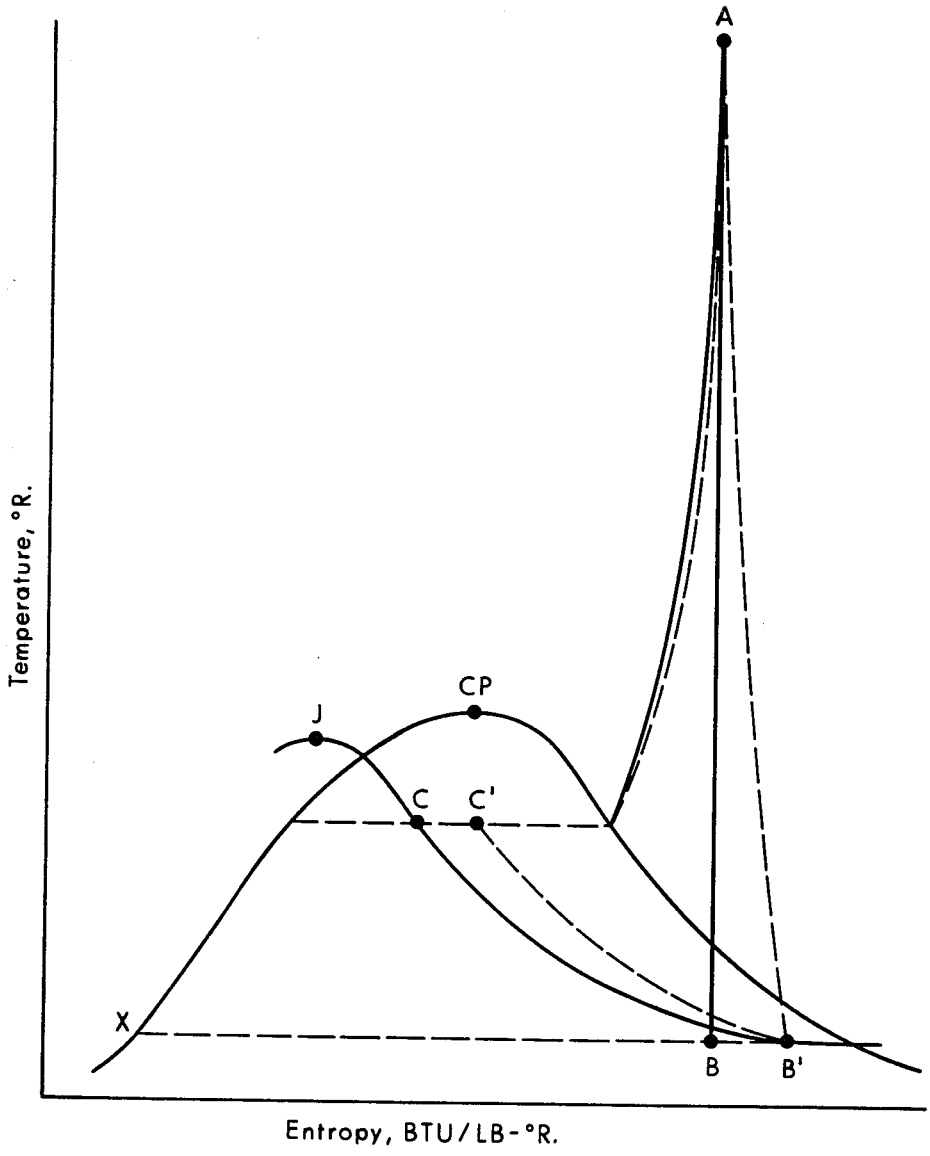
FIG. 1 is a temperature vs. entropy diagram for a typical working fluid and illustrates a typical path of the thermodynamic cycle of the invention.

FIG. 1 is a temperature vs. entropy chart for a typical working fluid used in the practice of this invention. As previously discussed, lines of constant pressure and enthalpy are used to interrelate certain thermodynamic functions which can define a given state of the working fluid. The dome-shaped curve depicts the boundary of the vapor-liquid phase region wherein the liquid and vapor phases may simultaneously co-exist. States A, B, and C are located in exemplary relative positions. State A represents the point of highest pressure $P_1$ and temperature $T_1$. State B represents the point of lowest pressure $P_2$ and temperature $T_2$. State C represents the system nominal high pressure $P_3$ which approximates $P_1$ and an intermediate temperature $T_3$ such that $T_2<T_3<T_1$. Points B', CP, J, C', and X are also located for clarification of certain theoretical points which were discussed in the "Summary of the Invention" section of this patent disclosure. It is along the B' to C constant enthalpy line that the "isenthalpic compression" of this invention is approximated for the reasons discussed at length in said "Summary of the Invention" section. States A, B, and C also serve as important reference points in the ensuing discussion of the representative devices which can produce the isenthalpic compression of this invention.

Figure 2:
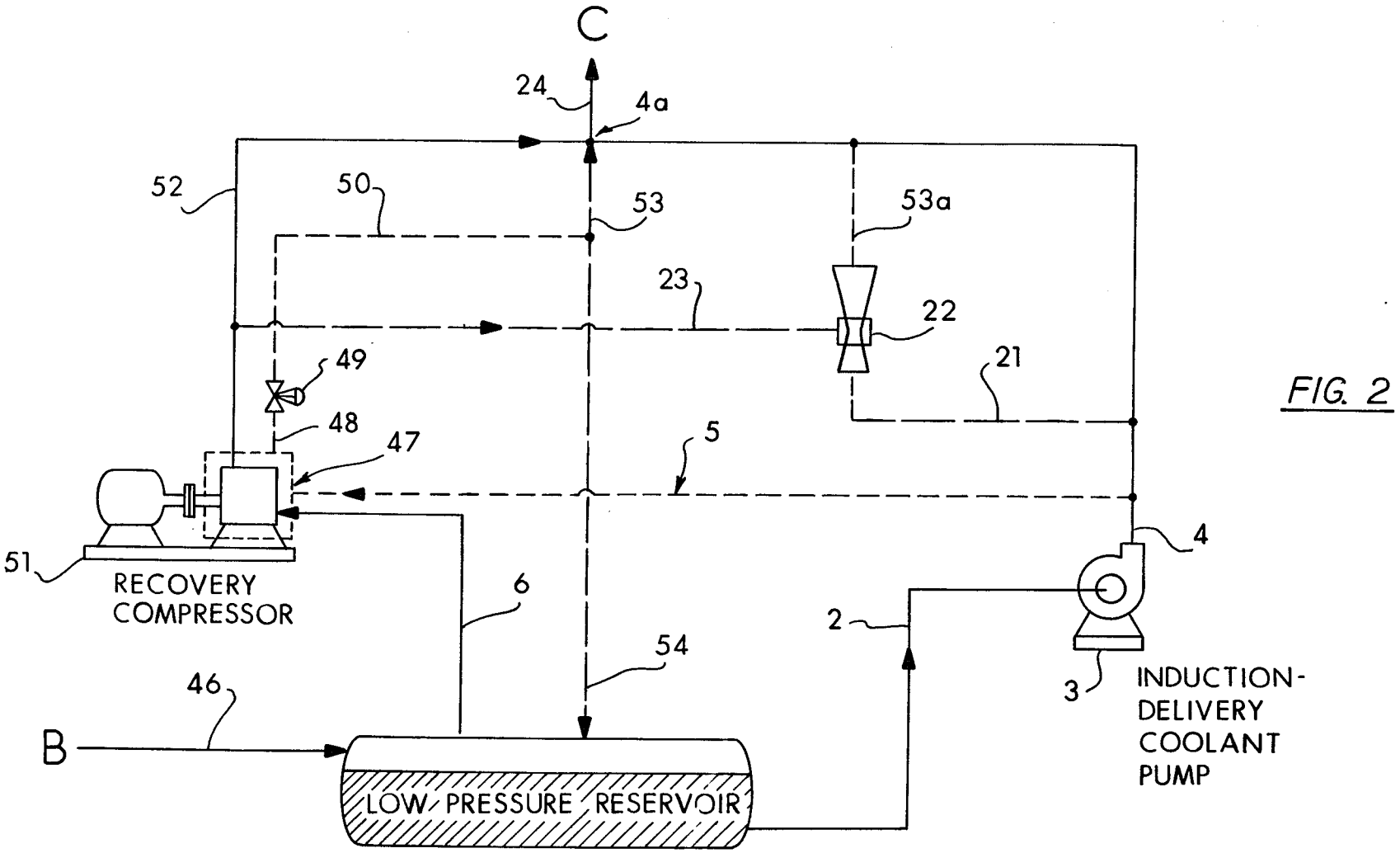
FIG. 2 is a schematic flow diagram of a direct compression system wherein a large quantity of a motive liquid is used to approximate an isenthalpic compression for the state B to state C transition taught by this invention. Alternatives are also shown in this diagram depicting some of the optional, more complex modifications envisioned as possible for the basic, simplest system.

FIG. 2 depicts three systems of increasing complexity incorporating the basic teachings of this invention. In all three only the central step of working fluid energizing, i.e., the approximate isenthalpic compression from state B to state C, is described, together with some means of motive fluid recovery, as the subsequent steps to state A and C are well known to those skilled in the art. For all three, the letters B and C locate the state points of the working fluid relating to the thermodynamic diagram of FIG. 1.

The first, shown throughout by unbroken lines, represents the exceptionally simple case of exhaust working fluid state B well inside the phase envelope, that is to say containing a substantial portion in the liquid phase. In such a state, the working fluid arrives via conduit 46 in the low pressure reservoir 1. The liquid fraction is drawn via conduit 2 to the suction of induction pump 3 where it is energized and delivered via conduit 4 to junction point 4*a* in state C. The vapor portion is drawn through conduit 6 to the suction of compressor 51 where it is compressed and delivered via conduit 52 to junction point 4*a* in state C. In this case, motive fluid can be virtually eliminated as substantial advantage can be realized in having only to compress a portion of the working fluid.

The second case applies to the general situation of moderately low pressure working fluid and required compression ratio. Here, shown by short broken lines, motive liquid is diverted from the discharge conduit 4 of delivery-coolant pump 3, via conduit 5 to the coolant jacket 47 of "isothermal type" compressor 51 where it is maintained at a pressure to preserve the liquid state by throttling valve 49. The coolant motive fluid leaves the jacket via conduit 48, valve 49, and conduit 50 to be delivered in its energized state in part to junction point 4*a* via conduit 53, and in circulating quantity to be returned via conduit 54 to reservoir 1. The working fluid, now having undergone an approximate isenthalpic compression in "isothermal type" compressor 51 flows via conduit 52 to junction point 4*a* in state C.

The third case, shown by long, dashed lines in FIG. 2, is especially useful in the case where different chemical species are present in the fluids. Here, extra care must be taken to provide intimate contact between the two energized fluids to restore chemical vapor-liquid equilibrium as well as physical. This is accomplished by returning the total coolant flow via conduit 54 to the reservoir from compressor 51 coolant jacket 47. An additional amount of liquid is circulated by induction-delivery coolant pump 3 and diverted via conduit 21 from pump discharge 4. Fed to the motive liquid inlet of jet eductor 22, it induces flow of working fluid to be diverted from compressor discharge 52, via conduit 23 to the eductor. There, the fluids are intimately mixed and delivered together via eductor discharge 53*a* to junction point 4*a* in state C.

Figure 2A:
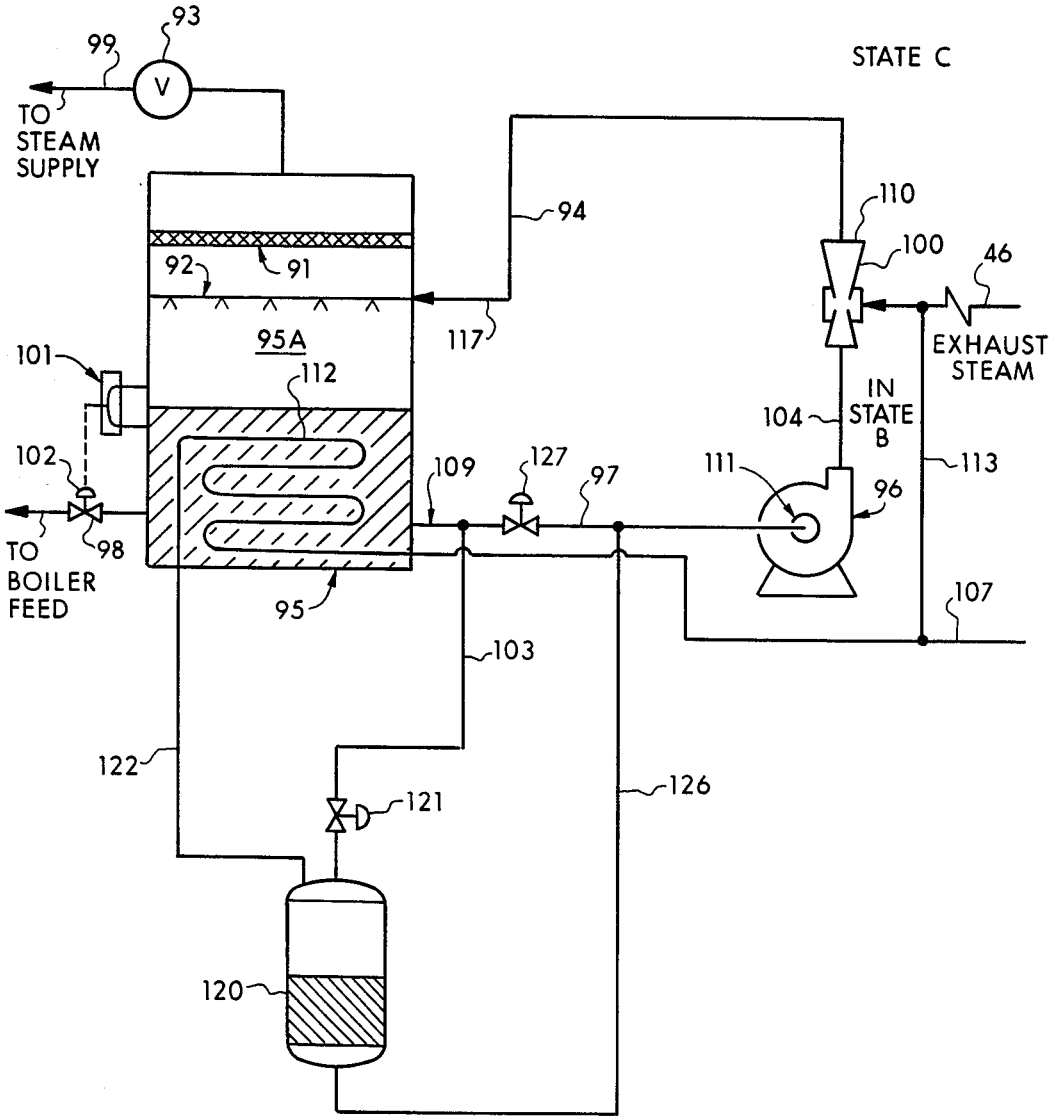
FIG. 2A is a schematic flow diagram depicting a disengaging drum employed for phase separation together with one of many possible configurations of Joule-Thompson expansion systems to provide an amount of sub-cooled motive liquid. An alternative is shown whereby the motive fluid may be totally recovered by ue of parasitic power.

Although some phase separation effects have been exemplified in FIG. 2 within the low pressure reservoir 1, the essential high pressure phase separation at state C has been reserved to be shown in FIG. 2*a* more clearly. Here, in a simpler case, motive liquid is withdrawn via conduit 109, flow control valve 127, and conduit 97 to be delivered to the suction conduit 111 of the motive liquid pump 96 where the motive liquid is energized and delivered via conduit 104 to the motive liquid inlet of eductor 100. This induces working fluid to flow to the suction inlet 108 of the eductor 100 via conduct 46. As in the final case of FIG. 2, the fluids are mixed and some further increase of working fluid pressure may be accomplished. The combined fluids at the eductor discharge 110 are delivered via conduit 94 to the spray nozzle 92 in the vapor space 95A of disengaging drum 95. Liquid entrained in the resulting equilibrium vapor is coalesced by the demister mesh of blanket 91 while the vapor flows to downstream process in state C via back pressure control valve 93 and conduit 99. All liquid falls in the drum where liquid level controller 101 operating control valve 102 provides that the flow of liquid surplus over motive liquid is maintained. Via conduit 98 and valve 102 this surplus is fed to suction 116 of feed pump 105. The net amount of working fluid in the liquid state C is delivered to process via pump discharge 103.

For the more complex case of Joule-Thompson expansion, the physical form of the disengaging drum may be the same or may be modified to that of a vertical heat exchanger (not shown) with a vapor disengaging space. The above flow pattern is modified by restricting flow through control valve 127, diverting motive liquid to flow through throttle valve 121 where it flashes to liquid and vapor in amounts depending upon downstream pressure. Chilled by evaporation, the fluids enter low pressure drum 120 from which, via conduit 126, subcooled motive liquid is supplied to the pump suction 111. The chilled vapor emerges from the low pressure drum 120 via conduit 122 to submerged cooling coil 112 pre-cooling the motive liquid to be flashed. Warmed itself, this vapor, if in small enough quantity, may be discarded via conduit 107 or if at sufficiently high pressure recycled via conduit 113 to the working fluid. At 113 parasitic power (not shown) may be employed to recompress this recycle, followed by ambient cooling (not shown) before return to the eductor suction 108.

This example is given by way of illustration and should not be considered as a limitation on the broader teachings of this invention. Many other obvious modifications could be made by those skilled in the art. At the very least, the principles of pumping incompressible liquids and reducing, insofar as possible without heat loss, the temperature rise in the compression of compressible fluids, and the use of motive liquids of chemical species other than the working fluid are all encompassed in the goal of isenthalpic compression, that is to say irreversible adiabatic compression, without departing from the spirit of this invention and the scope of the appended claims.

What is claimed is:

1. A process for approximating an isenthalpic compression of a working fluid from a state B (representing a pressure $P_2$ lower than a pressure $P_1$ of a state A and a temperature $T_2$ lower than a temperature $T_1$ of state A) to a state C (representing a pressure $P_3$ approximating $P_1$ and a temperature $T_3$ intermediate to temperatures $T_1$ and $T_2$ such that $T_2<T_3<T_1$) comprising:

energizing the working fluid in state B by (a) pumping a large quantity of a motive liquid to a pressure at least as great as $P_3$ and sufficiently high to preserve its liquid state while receiving sensible heat from the working fluid;

(b) communicating the working fluid with the pressured motive liquid in an overall adiabatic environment so that there is a local transfer of thermal energy between the two fluids while maintaining their physical separation, wherein the motive liquid serves to limit the temperature rise and prevent superheating of the working fluid by preserving the two fluids at equal temperatures; and (c) compressing the working fluid directly, while subject to these conditions, to a pressure $P_3$ and temperature $R_3$, during which compression there is at least partial condensation of the working fluid and concomitant release of the condensate latent heat of vaporization to the motive liquid, thus achieving state C for the working fluid.

2. The process of claim 1 which additionally comprises the step of cooling and/or deliberately discarding heat from at least one of the two fluids whereby selection of states A, B, and C for the two fluids is made possible for prescribed chemical species.

3. The process of claim 1 wherein the large quantity of motive liquid is provided by adjustment of the rate of recycling of a fixed motive liquid inventory.

4. The process of claim 1 wherein the large quantity of motive liquid is provided by an external source.

5. The process of claim 1 wherein the large quantity of motive liquid is provided by incorporating a recycle of the motive liquid inventory with motive liquid drawn from an external source.

6. The process of claim 1 wherein the large quantity of motive liquid is maintained by condensation of working fluid.

7. The process of claim 1 wherein some portion of the communication and mixing of the working fluid and motive liquid is accomplished by eduction of the working fluid into the motive liquid prior to and/or following the direct working fluid compression.

8. The process of claim 1 wherein some portion of the communication and mixing of the working fluid and motive liquid is accomplished by pressing a jet water heater into the role of a jet eductor so that said water heater educts the working fluid into the motive liquid prior to and/or following the direct working fluid compression.

9. The process of claim 1 wherein some portion of the energizing of the working fluid is accomplished by eduction of the working fluid into the motive liquid prior to and/or following the direct working fluid compression.

10. The process of claim 1 wherein a fluid system comprising the working fluid and the motive liquid is composed of essential quantities of more than one chemical species.

11. The process of claim 1 which additionally comprises performing a Joule-Thompson expansion of the motive liquid in order to provide for additional cooling as required.

12. A thermodynamic cycle process comprising:

(1) expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) energizing the working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid by (a) pumping a large quantity of a motive liquid to a pressure at least as great as $P_3$ and sufficiently high to preserve its liquid state while receiving sensible heat from the working fluid;

(b) communicating the working fluid with the pressured motive liquid in an overall adiabatic environment so that there is a local transfer of thermal energy between the two fluids while maintaining their physical separation, wherein the motive liquid serves to limit the temperature rise and prevent superheating of the working fluid by preserving the two fluids at equal temperatures; and (c) compressing the working fluid directly, while subject to these conditions, to a pressure $P_3$ and temperature $T_3$, during which compression there is at least partial condensation of the working fluid and concomitant release of the condensate latent heat of vaporization to the motive liquid, thus achieving state C for the working fluid;

(3) mixing a two-phase effluent of the direct compression with a throttled motive liquid coolant of a compressor while holding back pressure $P_3$ on the working fluid so that the two phases, a liquid and a vapor, resulting are in physical and chemical equilibrium, wherein the motive fluid is reconstituted in all respects in its initial state as a portion of the resulting liquid phase, and the quantity and composition of the working fluid is restored as the combination of the total resulting vapor and the remainder of the resulting liquid; and (4) heating the working fluid as necessary to achieve temperature $T_1$, thus reconstituting the working fluid in all respects in state A;

whereby an approximate isenthalpic compression of the working fluid is incorporated in a thermodynamic cycle.

13. The thermodynamic cycle process of claim 12 wherein the large quantity of motive liquid is provided by adjustment of the rate of recycling of a fixed motive liquid inventory.

14. The thermodynamic cycle process of claim 12 wherein the large quantity of motive liquid is provided by incorporating a recycle of a motive liquid inventory with motive liquid from an external source.

15. The thermodynamic cycle process of claim 12 wherein the large quantity of motive liquid is provided by maintaining its constant inventory through excessive condensation of working fluid.

16. The thermodynamic cycle process of claim 12 wherein the phase separation with back pressure control is accomplished by the action of a disengaging drum in which the surplus liquid outflow rate is under liquid level control and the vapor outflow rate is under upstream pressure control.

17. The thermodynamic cycle process of claim 12 wherein some portion of the physical communication and mixing of the working fluid and the motive liquid is accomplished by eduction of working fluid into motive liquid prior to and/or following the direct compression.

18. The thermodynamic cycle process of claim 12 wherein some portion of the physical communication and mixing of the working fluid and the motive liquid is accomplished by pressing a jet water heater into the role of a jet eductor so that said water heater educts working fluid into motive liquid prior to and/or following the direct compression.

19. The thermodynamic cycle process of claim 12 wherein the controlled temperature rise direct compression of the working fluid to approximate isenthalpic compression is accomplished by the action of a jacketed isothermal compressor employing pressured motive liquid as its coolant.

20. The thermodynamic cycle process of claim 12 wherein the energizing incorporates several stages of the direct isenthalpic compression therein described.

21. The thermodynamic cycle process of claim 12 which additionally comprises the step of cooling and/or deliberately discarding heat from at least one of the two fluids whereby selection of states A, B, and C is made possible for prescribed chemical species.

22. The thermodynamic cycle process of claim 12 wherein the heating of the resulting vapor is by use of ambient heat.

23. The thermodynamic cycle process of claim 12 wherein the heating of the resulting vapor is by use of an industrial waste heat source.

24. The thermodynamic cycle process of claim 12 wherein a portion of the heating of the working fluid and/or the cooling of the motive liquid takes place by interchange of heat in a device known as a heat exchanger.

25. The thermodynamic cycle process of claim 12 wherein the working fluid and the motive liquid are together comprised of more than one chemical species, the combination of which produces vapor-liquid phase envelopes the characteristics of each phase of which vary according to the relative proportions of the different chemical species present.

26. The thermodynamic cycle process of claim 12 wherein the working fluid is a mixture and the motive liquid is a different mixture.

27. The thermodynamic cycle process of claim 12 wherein the working fluid is essentially ammonia and the motive liquid is water with ammonia dissolved in it.

28. The thermodynamic cycle process of claim 12 wherein the working fluid is steam and the motive liquid is water.

29. The thermodynamic cycle process of claim 12 which additionally comprises performing a Joule-Thompson expansion of the motive liquid in order to provide for additional cooling as required.

30. A thermodynamic cycle process comprising:

(1) expanding a refrigerant working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) energizing the refrigerant working fluid from state B to state C representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid by (a) pumping a large quantity of a motive liquid to a pressure at least as great as $P_3$ and sufficiently high to preserve its liquid state while receiving sensible heat from the working fluid;

(b) communicating the working fluid with the pressured motive liquid in an overall adiabatic environment so that there is a local transfer of thermal energy between the two fluids while maintaining their physical separation, wherein the motive liquid serves to limit the temperature rise and prevent superheating of the working fluid by preserving the two fluids at equal temperatures; and (c) comprising the working fluid directly, while subject to these conditions, to a pressure $P_3$ and temperature $T_3$, during which compression there is at least partial condensation of the working fluid and concomitant release of the condensate latent heat of vaporization to the motive liquid, thus achieving state C for the working fluid;

(3) mixing a two-phase effluent of the direct compression with a throttled motive liquid coolant of a compressor while holding back pressure $P_3$ on the refrigerant working fluid so that the two phases, a liquid and a vapor, resulting are in physical and chemical equilibrium, wherein the motive fluid is reconstituted in all respects in its initial state as a portion of the resulting liquid phase, and the quantity and composition of the working fluid is restored as the combination of the total resulting vapor and the remainder of the resulting liquid; and (4) heating the refrigerant working fluid as necessary to achieve temperature $T_1$, thus reconstituting the working fluid in all respects in state A;

whereby an approximate isenthalpic compression of the working fluid is incorporated in a thermodynamic cycle.

31. The thermodynamic cycle process of claim 30 wherein the working fluid is a halogenated hydrocarbon refrigerant.

32. The thermodynamic cycle process of claim 30 wherein the working fluid is liquid nitrogen.

33. The thermodynamic cycle process of claim 30 wherein the working fluid is ammonia.

34. The thermodynamic cycle process of claim 30 wherein the cycle additionally comprises effecting a Joule-Thompson expansion of the working fluid.

35. The thermodynamic cycle process of claim 30 wherein the heating of the resulting vapor is accompanied by recovery of refrigeration.

36. The thermodynamic cycle process of claim 30 wherein the recovery of refrigeration is accompanied by evaporation of a fluid.

37. The thermodynamic cycle process of claim 30 wherein the working fluid is air.

38. The thermodynamic cycle process of claim 30 wherein the working fluid is ammonia containing minor amounts of water and the motive liquid is aqueous ammonia.

39. The thermodynamic cycle process of claim 30 which additionally comprises the step of cooling and/or deliberately discarding heat from at least one of the two fluids whereby selection of states A, B, and C for the two fluids is made possible for prescribed chemical species.

40. The thermodynamic cycle process of claim 30 wherein some portion of the communication and mixing of the working fluid and motive liquid is accomplished by eduction of the working fluid into the motive liquid prior to and/or following the direct working fluid compression.

41. The thermodynamic cycle process of claim 30 wherein the phase separation with back pressure control is accomplished by the action of a disengaging drum in which the surplus liquid outflow rate is under liquid level control and the vapor outflow rate is under upstream pressure control.

42. An apparatus for approximating an isenthalpic compression of a working fluid from a state B (representing a pressure $P_2$ lower than a pressure $P_1$ of a state A and a temperature $T_2$ lower than a temperature $T_1$ of state A) to a state C (representing a pressure $P_3$ approximating $P_1$ and a temperature $T_3$ intermediate to temperatures $T_1$ and $T_2$ such that $T_2<T_3<T_1$) comprising:

means for energizing the working fluid in state B through (a) means for pumping a large quantity of a motive liquid to a pressure at least as great as $P_3$ and sufficiently high to preserve its liquid state while receiving sensible heat from the working fluid;

(b) means for communicating the working fluid with the pressured motive liquid in an overall adiabatic environment so that there is a local transfer of thermal energy between the two fluids while maintaining their physical separation, wherein the motive liquid serves to limit the temperature rise and prevent superheating of the working fluid by preserving the two fluids at equal temperatures; and (c) means for compressing the working fluid directly, while subject to these conditions, to a pressure $P_3$ and temperature $T_3$ during which compression there is at least partial condensation of the working fluid and concomitant release of the condensate latent heat of vaporization to the motive liquid, thus achieving state C for the working fluid.

43. The apparatus of claim 42 which additionally comprises means for deliberately discarding heat from at least one of the two fluids whereby selection of states A, B, and C is made possible for prescribed chemical species.

44. The apparatus of claim 42 wherein the large quantity of motive liquid is provided by a fixed motive liquid inventory recycled at adjusted rates.

45. The apparatus of claim 42 wherein the large quantity of motive liquid is maintained by means for condensing a surplus of working fluid.

46. The apparatus of claim 42 wherein the means for direct compression of the working fluid is a jacketed isothermal compressor employing pressured motive liquid as its coolant.

47. The apparatus of claim 42 wherein the means for some portion of the communicating and mixing of the motive liquid and the working fluid is a jet eductor incorporated prior to and/or following the direct isenthalpic compression.

48. The apparatus of claim 42 wherein the means for some portion of the communicating and mixing of the motive liquid and the working fluid is a water heater pressed into the role of a jet eductor so that the water heater educts the working fluid into the motive liquid prior to and/or following the direct isenthalpic compression.

49. The apparatus of claim 42 wherein the system of two fluids is composed of more than one chemical species.

50. The apparatus of claim 42 wherein the means for phase separation with back pressure control is a disengaging drum in which the surplus liquid outflow rate is under liquid level control and the vapor outflow rate is under upstream pressure control.

51. A thermodynamic cycle apparatus comprising:

(1) turbine means for expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) means for energizing the working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid, by (a) means for pumping a large quantity of a motive liquid to a pressure at least as great as $P_3$ and sufficiently high to preserve its liquid state while receiving sensible heat from the working fluid;

(b) means for communicating the working fluid with the pressured motive liquid in an overall adiabatic environment so that there is a local transfer of thermal energy between the two fluids while maintaining their physical separation, wherein the motive liquid serves to limit the temperature rise and prevent superheating of the working fluid by preserving the two fluids at equal temperatures; and (c) means for compressing the working fluid directly, while subject to these conditions, to a pressure $P_3$ and temperature $T_3$ during which compression there is at least partial condensation of the working fluid and concomitant release of the condensate latent heat of vaporization to the motive liqud, thus achieving state C for the working fluid;

(3) means for mixing a two-phase effluent of the direct compression with a throttled liquid coolant of a compressor in a phase separator means, holding back pressure $P_3$ on the working fluid so that the liquid and vapor phases resulting are in physical and chemical equilibrium, wherein the motive fluid is reconstituted in all respects in its initial state as a portion of the resulting liquid phase, and the quantity and composition of the working fluid is restored as the combination of the total resulting vapor and the remainder of the resulting liquid; and (4) means for heating the working fluid as necessary to achieve temperature $T_1$, thus reconstituting the working fluid in all respects in state A;

whereby an approximate isenthalpic compression of the working fluid is incorporated in a thermodynamic cycle.

52. The thermodynamic cycle apparatus of claim 51 which additionally comprises means for cooling and/or deliberately discarding heat from at least one of the fluids whereby selection of states A, B, and C is made possible for prescribed chemical species.

53. The thermodynamic cycle apparatus of claim 51 wherein the large quantity of motive liquid is provided by means for adjusting the rate of recycle of a fixed motive liquid inventory.

54. The thermodynamic cycle apparatus of claim 51 wherein the large quantity of motive liquid is provided by means for incorporating a recycle of the motive liquid inventory with motive liquid from an external source.

55. The thermodynamic cycle apparatus of claim 51 wherein the large quantity of motive liquid is provided by means for maintaining its constant inventory through condensation of surplus working fluid.

56. The thermodynamic cycle apparatus of claim 51 wherein the means for phase separation is a disengaging drum with surplus liquid outflow rate under liquid level control and vapor outflow rate under upstream pressure control.

57. The thermodynamic cycle apparatus of claim 51 wherein the means for some portion of the communicating and mixing of the motive liquid and the working fluid is a jet eductor installed prior to and/or following the direct compression.

58. The thermodynamic cycle apparatus of claim 51 wherein the means for some portion of the communicating and mixing of the the motive liquid and the working fluid is a jet water heater pressed into the role of a jet eductor so that said jet water heater educts the working fluid into the motive liquid prior to and/or following the direct compression.

59. The thermodynamic cycle apparatus of claim 51 wherein the means for direct compression of the working fluid is a jacketed isothermal compressor employing pressured motive liquid as its coolant.

60. The thermodynamic cycle apparatus of claim 51 wherein the means for heating the resulting working fluid vapor is a heat exchanger using ambient heat.

61. The thermodynamic cycle apparatus of claim 51 wherein the means for heating the resulting working fluid vapor is a heat exchanger using an industrial waste heat source.

62. The thermodynamic cycle apparatus of claim 51 which additionally comprises a Joule-Thompson expansion means for sub-cooling at least one of the two fluids.

63. A thermodynamic cycle apparatus comprising:

(1) turbine means for expanding a refrigerant working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) means for energizing the refrigerant working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid, through (a) means for pumping a large quantity of a motive liquid to a pressure at least as great as $P_3$ and sufficiently high to preserve its liquid state while receiving sensible heat from the working fluid;

(b) means for communicating the working fluid with the pressured motive liquid in an overall adiabatic environment so that there is a local transfer of thermal energy between the two fluids while maintaining their physical separation, wherein the motive liquid serves to limit the temperature rise and prevent superheating of the working fluid by preserving the two fluids at equal temperatures and (c) means for compressing the working fluid directly, while subject to these conditions, to a pressure $P_3$ and temperature $T_3$ during which compression there is at least partial condensation of the working fluid and concomitant release of the condensate latent heat of vaporization to the motive liquid, thus achieving state C for the working fluid;

(3) means for mixing a two-phase effluent of the direct compression with a throttled liquid coolant of a compressor in a phase separator means, holding back pressure $P_3$ on the refrigerant working fluid so that the liquid and vapor phases resulting are in physical and chemical equilibrium, wherein the motive fluid is reconstituted in all respects in its initial state as a portion of the resulting liquid phase, and the quantity and composition of the working fluid is restored as the combination of the total resulting vapor and the remainder of the resulting liquid; and (4) means for heating the refrigerant working fluid as necessary to achieve temperature $T_1$, thus reconstituting the working fluid in all respects in state A;

whereby an approximate isenthalpic compression of the refrigerant working fluid is incorporated in a closed thermodynamic cycle having state A at ambient conditions.

64. The thermodynamic cycle apparatus of claim 63 which additionally comprises means for effecting a Joule-Thompson of at least one of the two fluids in order to provide a sub-cooled liquid.

65. The thermodynamic cycle apparatus of claim 63 which additionally comprises means for recovering refrigeration.

66. The thermodynamic cycle apparatus of claim 63 wherein the reconstitution of the working fluid and the motive liquid in chemical species and quantities is by means for single stage equilibrium flash vaporization.

* * * * *